US011208233B2

(12) United States Patent
Bourdin

(10) Patent No.: US 11,208,233 B2
(45) Date of Patent: Dec. 28, 2021

(54) BOX AND BLANK MADE FROM CARDBOARD SHEET WITH CONVEX CENTRING DEVICES

(71) Applicant: DS SMITH PACKAGING FRANCE, Puteaux (FR)

(72) Inventor: Olivier Bourdin, Villers-bretonneux (FR)

(73) Assignee: DS SMITH PACKAGING FRANCE, Puteaux (FR)

( * ) Notice: Subject to any disclaimer, the term of this patent is extended or adjusted under 35 U.S.C. 154(b) by 178 days.

(21) Appl. No.: 15/579,554

(22) PCT Filed: Jun. 3, 2016

(86) PCT No.: PCT/FR2016/051329
§ 371 (c)(1),
(2) Date: Dec. 4, 2017

(87) PCT Pub. No.: WO2016/193637
PCT Pub. Date: Dec. 8, 2016

(65) Prior Publication Data

US 2018/0162585 A1 Jun. 14, 2018

(30) Foreign Application Priority Data

Jun. 4, 2015 (FR) ..... 1555092

(51) Int. Cl.
*B65D 21/02* (2006.01)
*B65D 5/00* (2006.01)

(52) U.S. Cl.
CPC ..... *B65D 5/001* (2013.01); *B65D 5/003* (2013.01)

(58) Field of Classification Search
CPC ..... B65D 5/001; B65D 5/0015; B65D 5/002; B65D 5/0025; B65D 5/003; B65D 5/0035; B65D 5/0045; B65D 5/5021
(Continued)

(56) References Cited

U.S. PATENT DOCUMENTS 2,843,307 A * 7/1958 Goltz ..... B65D 5/0015 206/509
2013/0213847 A1* 8/2013 Moreau ..... B65D 5/001 206/509

(Continued)

FOREIGN PATENT DOCUMENTS

DE 202008014520 U1 1/2009
FR 2998275 A1 5/2014

(Continued)

OTHER PUBLICATIONS

JP2005170419Translation (Year: 2005).*

(Continued)

*Primary Examiner* — Nathan J Newhouse
*Assistant Examiner* — Nina K Attel
(74) *Attorney, Agent, or Firm* — Christensen O'Connor Johnson Kindness PLLC

(57) ABSTRACT

A box and a blank or a set of blanks made from corrugated cardboard sheet comprising side walls, a top wall linked to at least two of said opposing side walls by a junction line or a folded edge, and a bottom wall forming the bottom of the box. The top wall comprises at least two convex portions comprising a projecting part, and the bottom comprises at least two perforated surface portions of complementary shape arranged to engage with the projecting parts of the box below. Each convex portion comprises an oblique triangular or substantially triangular panel belonging partly to a side wall or a folded edge.

13 Claims, 4 Drawing Sheets

(58) Field of Classification Search
USPC ..... 229/915, 930, 931, 161
See application file for complete search history.

(56) References Cited

U.S. PATENT DOCUMENTS

| | | | | |
|---|---|---|---|---|
| 2015/0021226 | A1* | 1/2015 | Jacomelli ..... | B65D 5/001 206/508 |
| 2015/0291307 | A1 | 10/2015 | Bourdin et al. | |

FOREIGN PATENT DOCUMENTS

| | | | | |
|---|---|---|---|---|
| JP | 2005170419 | A | * | 6/2005 |
| JP | 2013184730 | A | * | 9/2013 |
| JP | 2013184730 | A | | 9/2013 |
| JP | 2013226661 | A | | 11/2013 |

OTHER PUBLICATIONS

JP2013184730Translation (Year: 2013).*
International Search Report dated Sep. 19, 2016, issued in corresponding International Application No. PCT/FR2016/051329, filed Jun. 3, 2016, 2 pages.
Written Opinion of the International Searching Authority dated Sep. 19, 2016, issued in corresponding International Application No. PCT/FR2016/051329, filed Jun. 3, 2016, 4 pages.
International Preliminary Report on Patentability dated Dec. 5, 2017, issued in corresponding International Application No. PCT/FR2016/051329, filed Jun. 3, 2016, 1 page.

* cited by examiner

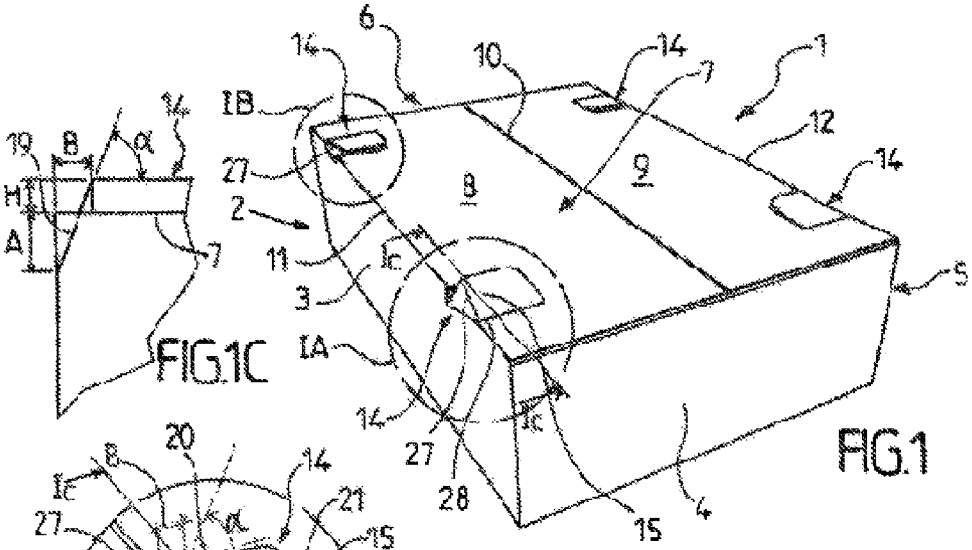
FIG.1C
FIG.1
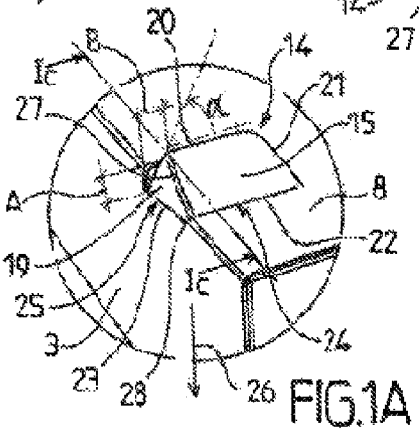
FIG.1A
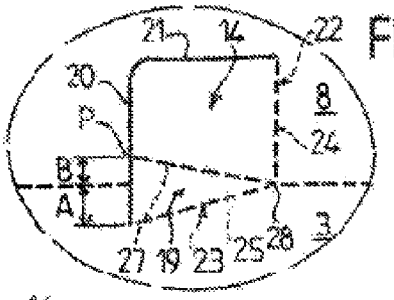
FIG.1D
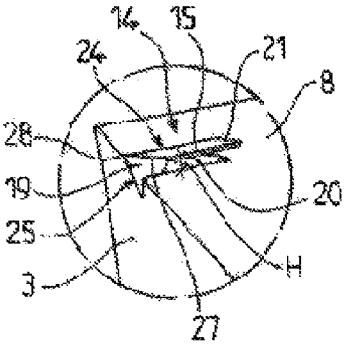
FIG.1B
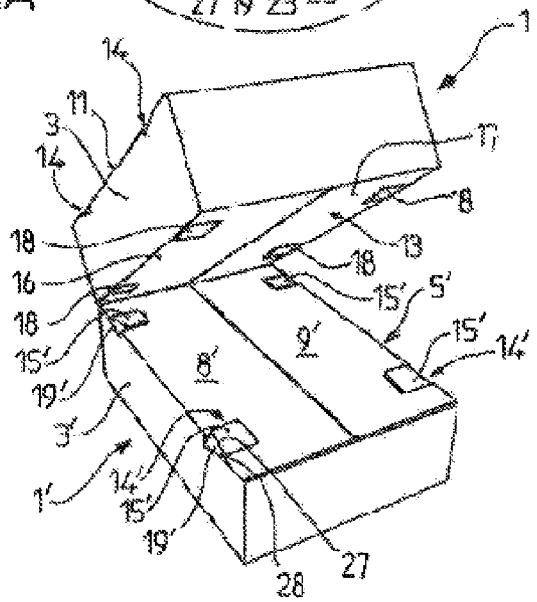
FIG.2

BOX AND BLANK MADE FROM CARDBOARD SHEET WITH CONVEX CENTRING DEVICES

The present invention relates to a box made from corrugated cardboard sheet material of the type comprising a top wall formed by flaps, ledges or ledge portions or, furthermore, a lid, with convex centering devices and a bottom wall with recesses so as to complement the form of the convex portions.

It also relates to a blank or set of blanks for making up such a box.

It further relates to a method for manufacturing such a box with convex centering devices.

It is particularly widely used, albeit not exclusively, in the field of boxes that can be stacked on a pallet, which may tend to slide over one another when handled during the transportation phase.

Box centering systems that make it possible to prevent their sliding, using vertically cut out side pegs that interact with orifices placed on the ridges, or in the vicinity, are already known.

Such systems are fragile, are unsuitable for sheet materials with a low weight per unit area, and do not withstand repeated handling.

Also known (FR 2 990 416) are boxes of the type mentioned above in which the top wall comprises convex portions cut out entirely from said wall and linked to the adjacent side face by a non-rectilinear junction line in order to form a deformable side that rises up upon folding.

Although this offers the advantage of it being possible to use such a system with sheet materials with a low weight per unit area, it does not, in particular, allow a great deal of engagement, which may be problematic in the case of merchandise that is shaken to any great extent.

In point of fact, new regulatory constraints aimed at ensuring better securing of transported loads are currently in preparation.

These relate, in particular, to the stability of packages on pallets, and are intended to set limits on the sliding of loads stacked in superposed layers at the time of braking and/or acceleration occurring during transportation.

The present invention aims to provide a box, a blank or set of blanks and a method for manufacturing a box made from corrugated cardboard sheet which fulfils practical requirements better than boxes known hitherto, in particular in that it allows, for all packaging configurations (crates, trays with ledges, lidded trays, wrap), complete stability of the layers of boxes stacked one upon another on a pallet, with excellent alignment of the bearing walls. The dimensions of the centering elements, which are formed automatically without gluing, can, furthermore, be easily calculated and/or adjusted as a function of the loads envisaged in the box and the constraints imposed by regulations.

With the invention, it will thus be possible to limit the risks of falling when truck doors are opened and pallets are handled, account being taken of the weight of the transported products, which makes it possible, therefore, to optimize the actual packaging.

The invention in fact allows a reduction in inter-layer sliding phenomena on account of better engagement of packages with one another, it being possible, in particular, for the convex parts to be dimensioned specifically and adapted to each type of load.

Compression strength may thus be minimized and the fibrous composition of the packaging optimized, while guaranteeing satisfactory behaviour of packages vis-à-vis one another.

The simple form of the centering system further makes it possible for it to be positioned on partially cut out American cases. It can be adapted to packaging lines already in place, without the addition of a gluing device.

The elasticity of the centering device enables it temporarily to withstand the horizontal pressure bands commonly found on flap closure machines. The assembly is, furthermore, compatible with an adhesive band flap closure.

Lastly, it can be used on any type of packaging geometry provided there is a 90° overlap of a flap, edge or ledge.

To this end, the present invention proposes, in particular, a box made from corrugated cardboard sheet material having a polygonal section, comprising side walls, a top wall linked to at least two of said opposite side walls by a junction line or a folded edge, and a bottom wall forming the bottom of the box, the top wall comprising at least two convex portions each comprising a part projecting from the surface of said top wall and the bottom comprising at least two portions with a surface perforated so as to complement said projecting parts, in line with the latter and arranged in order to engage in the projecting parts of the box below, characterized in that each convex portion comprises an oblique triangular or substantially triangular panel belonging partly to a side wall or a folded edge.

"Substantially triangular panel" is understood to mean a triangular panel comprising at least one side that may not be rectilinear (curved, for example concave).

"Oblique" is understood to mean oblique relative to the vertical plane of the side walls or relative to the horizontal plane of the top wall or top of the box.

"Convex portion" is understood to mean, in particular, a portion that is not solely located in one and the same plane and, in the present case, in the same plane as the external face of the top wall of the box.

In the present case, the part projecting from the top surface of the box of the convex portion will form the centering system, which, on account of the triangular or substantially triangular panel, will rise up automatically upon 90° folding of the flaps, edges or ledge portions.

On account of the third fold line or crease that is offset relative to the junction line of the top wall with the corresponding side wall, the material of the flap automatically stands up upon folding in order to create an extra thickness.

When two boxes are stacked on one another, the extra thickness is positioned in the perforated surface portions or openings provided in the bottom (flaps, or central sheet) of the box placed above.

With the invention, the centering element or centering device is thus formed from a portion of deformable material of trapezoidal overall shape, a part of which (the triangular panel) straddles a vertical wall of the box, the other part extending flat above, and two adjacent sides of which are cut out so as to allow same to rise up, while the other two sides are linked to the body of the packaging by fold lines or creased folds.

Rising is obtained automatically when the flap is folded at 90°, a portion of the centering device being forced to form an angle with the vertical on account of the triangular double fold.

As a function of the angle alpha formed between the triangle or oblique panel and the external face of the top wall, and also the distances of section A (in the side face) and B (in the top face), the projecting part is:

offset more or less toward the interior of the packaging;

more or less able to withstand vertical crushing and thus more or less elastic, which is of major interest in the case of a crossed-layer stack;

more or less prominent (rise height).

Thus, for one and the same rise height, there are a plurality of solutions of combinations of angles alpha, of length of sections A and B, which may thus be determined as a function of the centering effect sought, the desired elasticity and the resistance to flattening of the centering device, as will be further specified below with reference to the figures.

In other words, it is possible to adjust these parameters, particularly as a function of the other features of the box (cardboard thickness, quality, etc.) and of the load it is to contain, doing so in order to comply with imposed constraints on sliding/non-sliding.

In advantageous embodiments, recourse is, furthermore and/or moreover had to one and/or to another of the following arrangements:

each convex portion has four sides, namely two adjacent sides that are free or cut out from the top wall, the other two, opposite sides being, respectively, linked to the top wall by a first fold line and to the adjacent side wall or to the folded edge by a second fold line that is oblique toward the bottom of the box, and further comprises a third fold line, that is oblique and has a summit common with the first and second fold lines, in order to form the triangular or substantially triangular panel;

the third fold line is curved. Advantageously, it is concave;

the box forms a rectangular tray with ledge portions located at the four corners of the tray, which are symmetrical relative to the transverse axis of the tray, each ledge portion being formed by a flap having an end part forming the projecting part of the convex portion and by a median part linked to a tongue for fastening on the facing side wall adjacent the wall linked to the ledge portion;

the side walls form a belt and the top wall is formed by two flaps linked to two opposite walls by said junction lines;

the box is in the form of a rectangular tray and the top wall is formed by a lid provided with folded edges glued onto the external faces of the facing side walls after folding of the junction lines with the edges;

the oblique panel forms an angle alpha with the top face of the box of between 40° and 55°;

the top wall is a principal sheet of a wrap belt and the side walls are formed partly by flaps linked to said sheet by said junction lines.

The invention also proposes a blank or set of blanks that make it possible to obtain a box as described above.

It also proposes a blank or set of blanks made from corrugated cardboard sheet material intended for forming a box with a polygonal section comprising side walls, a top wall linked to two of said opposite side faces by a junction line, and one or more bottom faces forming the bottom of the box, characterized in that the top wall is formed by a pair of flaps, a pair of ledge portions, a lid with edges, or a wrap sheet, and comprises at least two portions each provided with an oblique substantially triangular panel belonging partly to a side wall or to an edge, straddling the junction line between walls or wall and edge, and capable of forming a convex portion creating a part projecting from the top surface of the box when the box is formed, and the bottom comprises at least two portions with a perforated surface so as to complement said projecting parts when they are formed, in line with the latter when the box is formed and arranged in order to engage in the projecting parts of a box below.

Advantageously, each portion capable of forming a convex portion has four sides, namely two adjacent sides that are free or cut out from the top wall, the other two, opposite sides being, respectively, linked to the top wall by a first fold line and to the side wall or to the edge of the lid by an oblique second fold line, and further comprises a third fold line that is oblique and has a summit common with the first and second fold lines, in order to form the triangular or substantially triangular panel.

Likewise, advantageously, the third fold line is curved, and advantageously concave with a concavity corresponding to a radius of curvature of between 20 cm and 80 cm.

In an advantageous embodiment, the blank is capable of forming a rectangular tray with ledge portions located at the four corners of the tray, which are symmetrical relative to the transverse axis of the tray.

Each ledge portion is formed by a flap having an end part forming the projecting part of the convex portion and by a median part connected to a tongue for fastening on the facing side wall when the box is formed.

Likewise, advantageously, the third fold line or the tangent to the summit of the third fold line forms an angle beta with the junction line of between 15° and 45°.

The invention also proposes a method for manufacturing a box as described above.

The invention will be better understood upon reading the following description of embodiments given below by way of non-limiting examples. The description makes reference to the drawings that accompany it, in which:

FIG. 1 is a perspective view of a box according to a first embodiment of the invention.

FIGS. 1A and 1B are perspective front and rear views of a convex centring device of FIG. 1.

FIG. 1C is a section on Ic-Ic of the convex portion of FIG. 1A.

FIG. 1D is a flattened view of the convex portion before folding of the flap at 90°.

FIG. 2 is a perspective view showing two boxes according to FIG. 1 engaging in one another.

FIG. 1A) and of the angle $\alpha$ as a function of a fixed height of the convex centring device (in this case, 10 mm) relative to the top face of the top wall.

FIG. 1 shows a parallelepipedal box 1 made from corrugated cardboard sheet, for example double-face cardboard sheet that is 3 mm thick.

Figure 3:
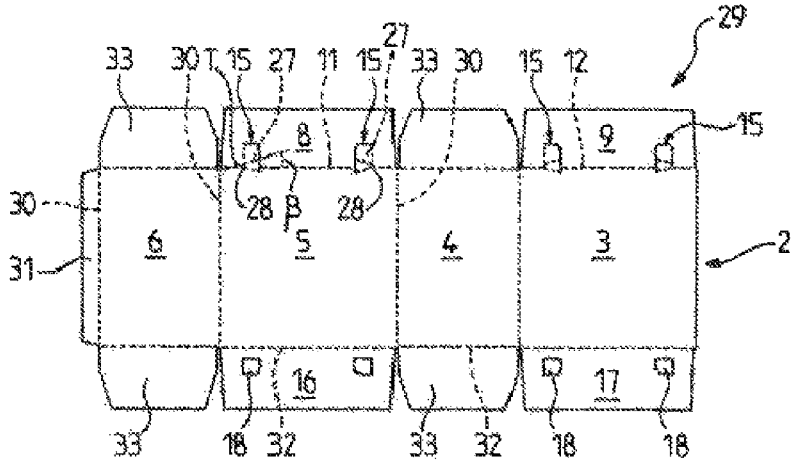
FIG. 3 is a plan view of the blank that makes it possible to obtain the box of FIG. 1.

The box 1 comprises a belt 2 of rectangular side walls 3, 4, 5, 6, a top wall 7 formed by two rectangular flaps 8, 9 contiguous at their ends 10, linked to two corresponding side walls 3, 5 by opposite junction lines 11, 12 and a bottom wall 13 (see FIG. 2) forming the bottom of the box.

The top wall comprises four convex portions 14 (cf., also, FIGS. 1B, 1C and 1D) each comprising a part 15 projecting from the external face of the top wall.

The bottom wall 13 is also formed by two opposite flaps 16 and 17, contiguous at their ends and comprising, for each of the flaps, two perforated surface portions 18 arranged so as to engage with the projecting parts 15' of the box 1' below (see FIG. 2) and having, in the present case, a trapezium shape, possibly with an angle at the inclined base of a few degrees in the same direction.

Each convex portion 14, 14' comprises a triangular or substantially triangular panel 19, 19' belonging partly to an adjacent side wall 3, 3', 5, 5'.

More precisely, with reference to FIGS. 1A, 1B, 1C and 1D, each convex portion 14 is of generally trapezoidal shape and comprises four sides, namely two adjacent sides 20, 21 cut out in the flap 8 of the top wall, the other two sides 22, 23 being, respectively, linked to the top wall 8 by a first fold line 24 partially perforated in order to allow reverse folding of the projecting part of the centering device, and to the adjacent wall 3 by a second fold line 25 that is oblique toward the bottom (arrow 26) of the box.

The convex portion 14 further comprises a third oblique fold line 27, which is concave and has a summit 28 common with the first and second fold lines 24 and 25 in order to form the diamond-like triangular panel 19.

In this embodiment, the oblique panel 19 forms an angle $\alpha$ with the top face 7 (flap 8) of the box of 60°.

Mechanically, the convex portion will undergo slight twisting at the point P at the time of rising (cf. FIG. 1D).

The point P will then move laterally toward the interior of the surface of the case.

According to the embodiment of the invention more particularly described here, it is assumed here that this point P rises strictly vertically upon folding of the flap, at a distance B from the vertical edge of the case, which allows a simple mathematical equation for determining A and B (thus, A+B, which is the necessary sizing dimension), this being as a function of the angle $\alpha$ sought and of the rise height H.

In this case, there is the following equation: tangent (alpha)=(A+H)/B, which gives excellent sizing, as will be seen precisely below with reference to FIG. 4.

FIG. 3 shows the blank 29 that makes it possible to obtain the box of FIG. 1.

It is formed from the belt 2 comprising the four side walls 3, 4, 5, 6 in the form of rectangular sheets linked by mutually parallel fold lines 30. The belt 2 ends in a gluing tongue 31 in a manner known per se. Advantageously, the box is formed around a mandrel, which allows it to be perfectly square and permits, as a result, faultless alignment and engagement between projecting parts 15 and recesses 18.

Each wall 3 and 5 is linked to the corresponding flaps 8 and 9 (provided with the centering devices), on the one hand, by a junction line 11 and 12, and on the other to the flaps 16, 17 provided with the recesses 18 by fold lines 32.

Flaps 33 are linked on either side to the walls 4 and 6 in a manner known per se in order to form the interior, at least in part, of the top face of the box.

As indicated above, the centering system is formed automatically upon 90° folding of the flaps 8, 9 owing to the diamond shape, the tangent T at the summit 28 of the third fold line 27 being, for example, an angle $\beta$ of 20'.

With the invention, it will be possible to precisely and adjustably size the height of the projecting part 15 or height of the centering device.

One of the advantages of the system is, moreover, that it makes it possible, as a function of the angle $\alpha$ and of the section parameters A and B, to arrange for the projecting part of the centering device to be more or less distant (distance x=B) from the vertical side wall of the box, which makes it possible to conserve more or less material between the exterior edge of the perforated part receiving the projecting part and said edge, and thereby to avoid the start of tearing.

Figure 4:
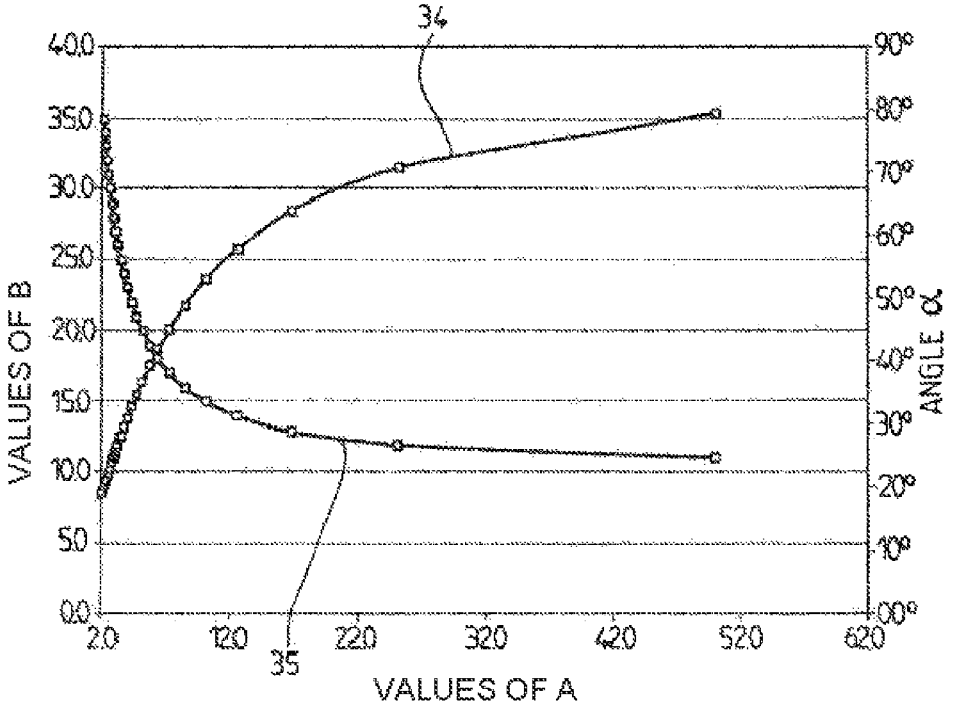
FIG. 4 shows a graph giving the values of the section dimensions A and B (cf.

FIG. 4 shows the values of the dimensions A (abscissa), B (ordinate) and angle $\alpha$ as a function of the centering height H, in this case taken in the example to be 10 mm (cf. FIG. 1A) (cf. curves 34 and 35).

More precisely, for a given height, for example, H=10 mm, and a given section A, the value of B and of the angle alpha on the curves according to the equation defined above result automatically. For manufacturing reasons (difficulty in forming creases that are too close together), a value A+B greater than 6 or 8 mm will be sought.

It will be seen that there is a plurality of possible solutions of (A) and (B) pairs for the same rise height, the angle alpha depending on each of the pairs.

The designer will thus have to select, on the graph, the correct (A) and (B) pair to suit whether he wishes to prioritize an offset (B) that is more or less great or, on the contrary, to prioritize the angle alpha.

In Table I below, for a required height of 10 mm, if the designer desires a solution with an angle alpha close to 40° in order to obtain significant elasticity the only solution is to fix (A) at 5.6 mm and thus (B) will be equal to 19 mm. The leading edge of the centering tab will thus be offset at 19 mm from the vertical edge of the case.

If the designer wishes above all else that the offset (B) should not exceed 15 mm, while the value of the vertical section (A) should be 10 mm and the angle alpha will be 53°, he will thus have less elasticity at the time of vertical crushing of the tab (by a roller closing the tabs by gluing, for example).

Obviously, a person skilled in the art will without difficulty select other heights.

The values of the curves are likewise given by way of example in Table I below, the values of A, B and H being expressed in mm.

Furthermore, and for structural reasons, the following values are chosen advantageously and by way of example:

A+B mini: 8 mm, A mini: 2 mm, $\alpha$ mini=40° and $\alpha$ maxi: 55°.

TABLE I

| H | A | B | Alpha |
|---|---|---|---|
| 10 | 50.0 | 11 | 80° |
| | 25.0 | 12 | 71° |
| | 16.7 | 13 | 64° |
| | 12.5 | 14 | 58° |
| | 10.0 | 15 | 53° |
| | 8.3 | 16 | 49° |
| | 7.1 | 17 | 45° |
| | 6.3 | 18 | 42° |
| | 5.6 | 19 | 39° |
| | 5.0 | 20 | 37° |
| | 4.5 | 21 | 35° |
| | 4.2 | 22 | 33° |
| | 3.8 | 23 | 31° |
| | 3.6 | 24 | 29° |
| | 3.3 | 25 | 28° |

TABLE I-continued

| H | A | B | Alpha |
|---|---|---|---|
| | 3.1 | 26 | 27° |
| | 2.9 | 27 | 26° |
| | 2.8 | 28 | 25° |
| | 2.6 | 29 | 24° |
| | 2.5 | 30 | 23° |
| | 2.4 | 31 | 22° |
| | 2.3 | 32 | 21° |
| | 2.2 | 33 | 20° |
| | 2.1 | 34 | 20° |
| | 2.0 | 35 | 19° |

In the remainder of the description, use will be made of the same reference numbers to denote the same elements or similar elements.

Figure 5:
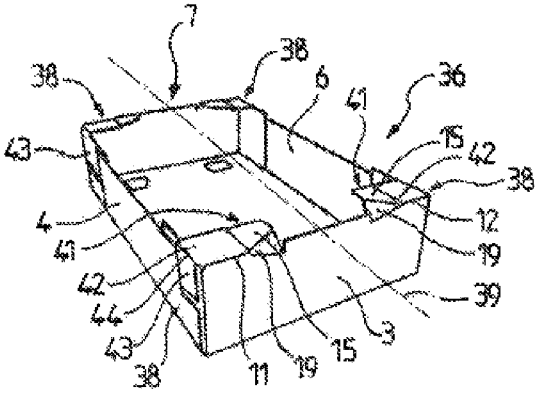
FIG. 5 is a perspective view of a box according to a second embodiment, in the form of a tray with ledge portions.
Figure 6:
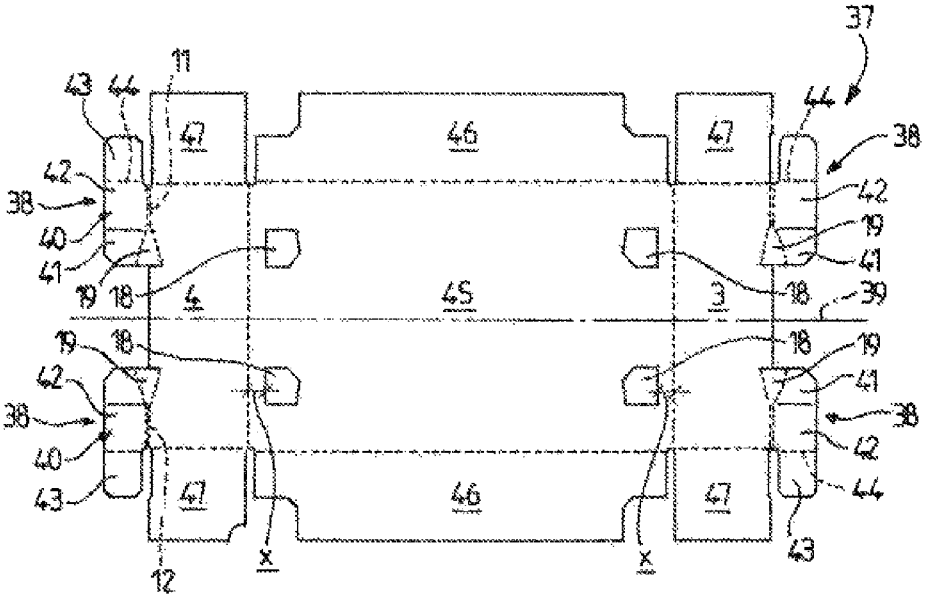
FIG. 6 is a plan view of the blank that makes it possible to obtain the box of FIG. 5.

FIGS. 5 and 6 show, respectively, a tray 36 and the blank 37 that makes it possible to obtain the tray.

In this case, the top wall 7 is formed by ledge portions 38 located at the four corners of the tray, which are symmetrical relative to the transverse axis 39 of the tray.

Each portion 38 is formed by a flap 40 having an end part 41 forming the projecting part 15 of the convex part, as described above (triangle 19, etc.) and by a median part 42 linked to a tongue 43 by a fold line 44, for fastening on the side wall 4, 6 adjacent to the wall 3, 5 linked to the ledge portion 38 by the junction line 11, 12.

The tray is, furthermore, formed in a manner known per se with a rectangular sheet forming the bottom 45 provided with recesses 18, respectively located at the distance x=B from the corresponding walls, and determined as described above.

The other two, opposite side walls are formed by the flaps 46 linked to the central sheet 45 by fold lines and by the lateral flaps 47 attached to the walls 3 and 4 and folded down/glued onto the internal face of the flaps 46, in a manner known per se.

Figure 7:
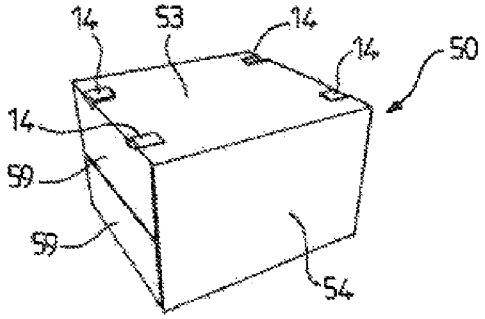
FIG. 7 is a perspective view of a third embodiment of a box according to the invention, in wrap form.
Figure 8:
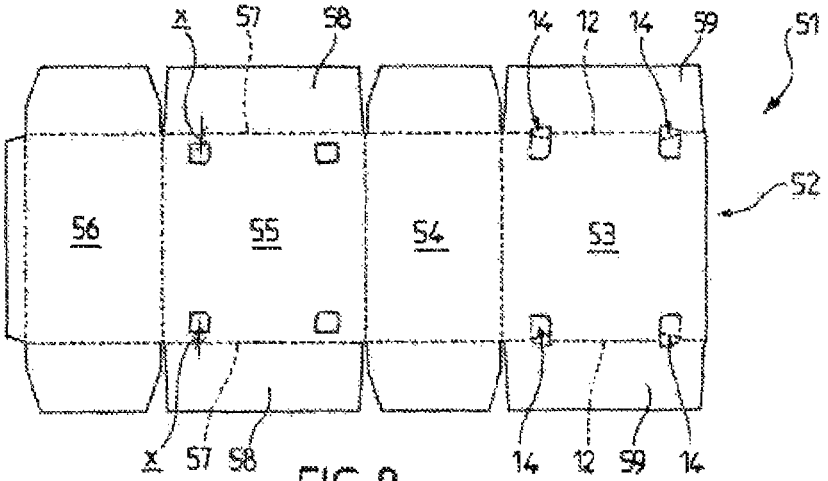
FIG. 8 is a plan view of the blank of the box in FIG. 7.

FIG. 7 shows a box 50 formed from the wrap 51 of FIG. 8 provided with the convex centering devices 14.

The blank is formed by a belt 52 of sheets 53, 54, 55, 56, the wall 53 comprising the convex centering devices and the wall 55 the recesses 18 located at the distance x=B from the junction line 57 between the sheets 55 and the rectangular flaps 58, in line with said convex elements.

The centering devices or convex elements 14 are, in the meantime, on the sheet 53, straddling the junction lines 12, as described above, with the flaps 59.

Figure 9B:
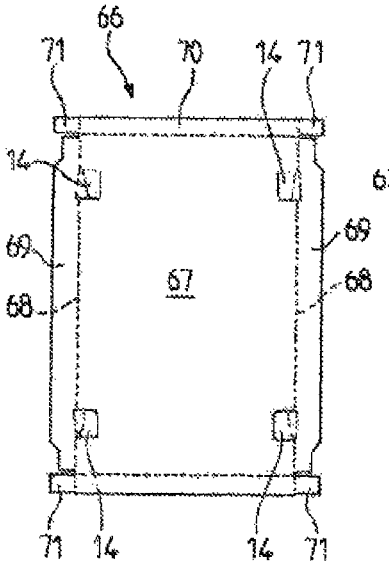
FIGS. 9A and 9B show plan views of a set of blanks for forming a box with a lid, according to a fourth embodiment of the invention.
Figure 9A:
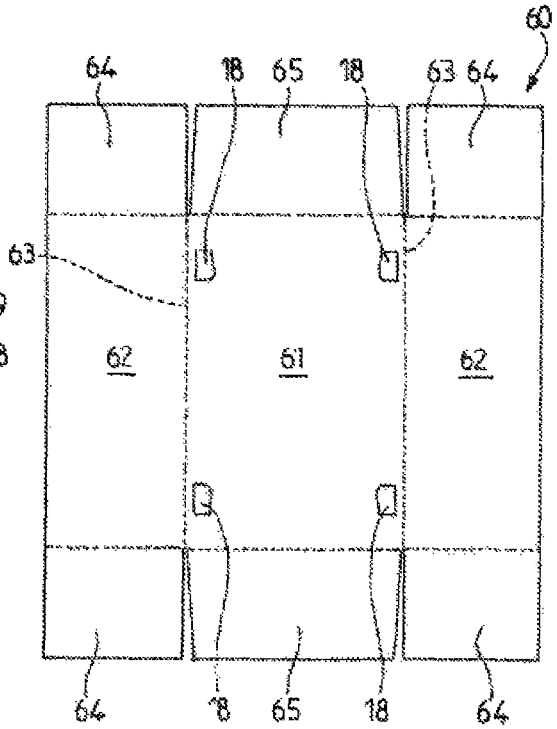

FIGS. 9A and 9B, in the meantime, show, in top view, the blank 60 forming a tray in a manner known per se, with a rectangular central sheet 61 and rectangular lateral flaps 62 attached by fold lines 63 to said sheet.

Each flap 62 comprises on either side end flaps 64 arranged in order to be glued onto the external or internal face of the adjacent flap 65, in a known manner.

The recesses 18 are close to the fold lines 63 in the sheet 61.

FIG. 9B shows the lid 66 comprising a central sheet 67 provided with convex centering devices 14 straddling the junction lines 68 between the flaps 69 to be folded down and said sheet 67. The sheet 67 also comprises, on its two opposite sides, edges 70 with end tongues 71 for achieving the lid once folded down.

A description will now be given of the implementation of the process and of the method corresponding to the invention described more particularly, especially with reference to FIGS. 1, 1A and 1B.

On the basis of a specific load, weight per unit area and box size, the desired engagement height H and the acceptable distance x are determined. Then, by means of simple calculation and triangulation, the values A and B and the angle $\alpha$ to be selected are determined, by virtue, in particular, of curves of the type described with reference to FIG. 4.

Next, using a blank made from sheet material of the type described with reference to FIG. 3, said blank is rolled around a packaging mandrel. This packaging will then be filled with a product prior to the flaps being folded over.

In a first stage, the interior flaps 33 are folded down, and then the top flaps 8 and 9 are folded down about their junction lines 11 and 12. When the junction line has been folded, the convex centering devices then automatically stand up owing to the triangular part. The projecting parts of height H located at the distance x from the edges are then formed.

The flaps having had glue applied previously onto their internal face thus make it possible to fully form the top face 7.

Next (cf. FIG. 2), the cases will be stacked, the recesses of the top cases being engaged in the convex centering devices of the bottom cases so as to obtain a stack of boxes that is perfectly square, one in line with the other, and engaged so as to prevent any sliding should the stack be placed at an angle when stresses likely to arise during transportation occur.

As is obvious and also follows from the aforesaid, the present invention is not limited to the embodiments more particularly described. It encompasses, on the contrary, all variants thereof and, in particular, those in which the recesses comprise at least one rounded angle or are of rectangular or square shape.

The invention claimed is:

1. A box made from corrugated cardboard sheet material having a polygonal section, comprising:

side walls;

a top wall linked to at least two opposing side walls of said side walls by a junction line or a folded edge linked to the top wall by a junction line; and a bottom wall forming a bottom of the box, the top wall comprising at least two convex portions automatically formed when said junction lines have been folded and comprising a part projecting from a surface of said top wall, and the bottom has a surface comprising at least two perforated portions that complement said projecting parts, are in line with a respective one of said at least two convex portions, and are arranged in order to engage in the projecting parts of a box below, wherein each of said at least two convex portions comprise an oblique, three-sided panel having a triangular or substantially triangular panel surface belonging partly to a respective one of the said side walls or a respective one of said folded edges.

2. The box as claimed in claim 1, wherein each of said at least two convex portions has four sides, including first and second sides that are adjacent and third and fourth sides that are adjacent, wherein the first and second sides are free or cut out from the top wall, wherein the third side is linked to the top wall by a first fold line, and wherein the fourth side is linked to the respective one of the side walls or to the respective one of the folded edges by a second fold line that is oblique toward the bottom of the box, and wherein each of the at least two convex portions further comprises a third fold line, that is oblique and has a summit common with the first and second fold lines, in order to form the oblique, triangular or substantially triangular panel surface.

3. The box as claimed in claim 2, wherein the third fold line is curved.

4. The box as claimed in claim 1, wherein the oblique, triangular or substantially triangular panel surface forms an angle alpha with the top wall of the box of between 40 and 55 degrees.

5. The box as claimed in claim 1, wherein the side walls form a belt, and in that the top wall is formed by two flaps linked to the at least two opposing side walls of said side walls by said junction lines.

6. The box as claimed in claim 1, in the form of a rectangular tray, wherein the top wall is formed by a lid provided with said folded edges glued onto external faces of the at least two opposing side walls of said side walls after folding of the edges.

7. The box as claimed in claim 1, in the form of a rectangular tray, wherein the top wall being formed by ledge portions located at four corners of the tray, which are symmetrical relative to a transverse axis of the tray, each ledge portion is formed by a flap having an end part forming the projecting part of one of said at least two convex portions and by a median part linked to a tongue for fastening on a facing one of the side walls adjacent the side wall linked to the ledge portion.

8. The box as claimed in claim 1, wherein the top wall is a principal sheet of a wrap belt and the side walls are formed partly by flaps linked to said sheet by said junction lines.

9. A blank or set of blanks made from corrugated cardboard sheet material intended for forming a box with a polygonal section comprising:

side walls;

a top wall linked to two opposing side walls of said side walls by a junction line; and one or more bottom walls forming a bottom of the box, wherein the top wall is formed by any of a pair of flaps, a pair of ledge portions, a lid with edges, or a wrap sheet and comprises at least two portions each provided with an oblique, three-sided panel having a substantially triangular panel surface belonging partly to a respective one of the side walls or to a respective one of the edges of the lid, straddling the junction line between the top wall and the respective one of the side walls or between the top wall and the respective one of the edges of the lid, and capable of automatically forming at least two convex portions when said junction lines have been folded, each creating a part projecting from a top surface of the box when the box is formed, and the bottom has a surface that comprises at least two perforated portions of the surface that complement said projecting parts when they are formed, are in line with a respective one of the said at least two convex portions when the box is formed and arranged in order to engage in the projecting parts of a box below.

10. The blank or set of blanks as claimed in claim 9, wherein each of the at least two portions capable of forming the at least two convex portions has four sides, including first and second sides that are adjacent and third and fourth sides that are adjacent, wherein the first and second sides are free or cut out from the top wall, wherein the third side is linked to the top wall by a first fold line and wherein the fourth side is linked to the respective one of the side walls or to the respective one of the edges of the lid by an oblique second fold line, and further comprises a third fold line that is oblique and has a summit common with the first and second fold lines, in order to form the oblique, triangular or substantially triangular panel surface.

11. The blank as claimed in claim 10, wherein the third fold line is curved.

12. The blank as claimed in claim 10, wherein the third fold line or a tangent to the summit of the third fold line forms an angle beta with the junction line of between 15° and 45°.

13. A box made from corrugated cardboard sheet material having a polygonal section, comprising:

side walls;

a top wall linked to at least two opposing side walls of said side walls by a junction line or a folded edge; and a bottom wall forming a bottom of the box, the top wall comprising at least two convex portions comprising a part projecting from a surface of said top wall, and the bottom has a surface comprising at least two perforated portions that complement said projecting parts, are in line with a respective one of said at least two convex portions, and are arranged in order to engage in the projecting parts of a box below, wherein each of said at least two convex portions comprise an oblique, three-sided panel having a triangular or substantially triangular panel surface belonging partly to a respective one of the said side walls or a respective one of said folded edges, wherein the oblique, triangular or substantially triangular panel surface forms an angle alpha with the top wall of the box of between 40 and 55 degrees.

* * * * *